US006702213B2

(12) United States Patent
Kotzur et al.

(10) Patent No.: US 6,702,213 B2
(45) **Date of Patent: *Mar. 9, 2004**

(54) MOLDED FIBER AND PLASTIC TUBES

(76) Inventors: Frank W. Kotzur, R.D.#3 Ninham Rd., Carmel, NY (US) 10512; Aaron B. Harman, 87 Pine Ridge Rd., Hopewll, NY (US) 16533

( * ) Notice: Subject to any disclaimer, the term of this patent is extended or adjusted under 35 U.S.C. 154(b) by 137 days.

This patent is subject to a terminal disclaimer.

(21) Appl. No.: 10/006,673

(22) Filed: Dec. 10, 2001

(65) Prior Publication Data

US 2003/0075639 A1 Apr. 24, 2003

Related U.S. Application Data

(63) Continuation-in-part of application No. 09/624,420, filed on Jul. 24, 2000, now Pat. No. 6,341,741.

(51) Int. Cl.[7] ..... B65H 55/02; B65H 57/12

(52) U.S. Cl. ..... 242/163; 242/171; 242/131.1; 242/157 R

(58) Field of Search ..... 242/163, 170, 242/171, 159, 137, 137.1, 138, 141, 146, 157 R; 206/395, 409

(56) References Cited

U.S. PATENT DOCUMENTS

| | | | | | |
|---|---|---|---|---|---|
| 2,738,145 | A | * | 3/1956 | Taylor | 242/163 |
| 2,943,732 | A | * | 7/1960 | Kovaleski et al. | 242/170 |
| 3,178,130 | A | * | 4/1965 | Taylor | 242/163 |
| 3,666,200 | A | * | 5/1972 | Newman et al. | 242/163 |
| 3,985,315 | A | | 10/1976 | Newman | |
| 4,022,399 | A | | 5/1977 | Zajac | |
| 4,057,203 | A | | 11/1977 | Newman et al. | |
| 4,274,607 | A | | 6/1981 | Priest | |
| 4,367,853 | A | | 1/1983 | Kotzur | |
| 4,373,687 | A | * | 2/1983 | Zicko | 242/163 |
| 4,523,723 | A | * | 6/1985 | Kotzur | 242/163 |
| 5,150,852 | A | * | 9/1992 | Hunt et al. | 242/163 |
| 5,470,026 | A | * | 11/1995 | Kotzur | 242/163 |
| 5,520,347 | A | * | 5/1996 | Bass et al. | 242/163 |
| 5,979,812 | A | * | 11/1999 | Kotzur et al. | 242/163 |

* cited by examiner

*Primary Examiner*—John M. Jillions

(57) ABSTRACT

A payout tube for insertion in a radial hole of a wound coil of filamentary material and the radial hole extending from the inner to the outer wind of the wound coil, the payout tube including an entrance and an exit opening in coaxial and spaced relationship with one another; the size of the entrance opening is determined by the following:

$$Yc=3.5 \sin x/Dm$$

where Dm is a diameter of the mandrel on which the coil of filamentary material is wound, x is the length along the circumference of the wind and Yc is the substantially sinusoidal FIG. 8 coil pattern;

$$Yc'=3.5Dm \text{ Cos } x/Dm; \text{ at } x=0; Yc'=3.51/Dm;$$

and the slope H of the coil pattern=$\text{Tan}^{-1}$ [3.5/Dm]=23.629 degrees; the length L of the opening is determined as: L=PTO×Dm×pi/360 degrees; where PTO is the size of the entrance opening in degrees; the width of the payout tube is W=L Cos(H); the size of the exit opening is determined as being a fixed amount of degrees less than the entrance opening; and a flange member surrounding the exit opening for engaging a panel of a container retaining the wound coil.

17 Claims, 8 Drawing Sheets

MOLDED FIBER AND PLASTIC TUBES

RELATED APPLICATIONS

This application is a continuation application of application Ser. No. 09/624,420 filed Jul. 24, 2000, issued Jan. 29, 2002, now U.S. Pat. No. 6,341,741, and is related to application Ser. No. 09/157,317, filed Sep. 21, 1998 and entitled: "Combined Fiber Containers and Payout Tubes and Plastic Payout Tubes", now U.S. Pat. No. 6,109,554; and is also related to application Ser. No. 09/063,278, filed Apr. 21, 1998 and entitled: "Coil with Large Payout Hole and Tube for Kinkless Payout", now U.S. Pat. No. 5,979,812; and application Ser. No. 09/370,248, filed Aug. 9, 1999 and entitled: "Combined Fiber Containers and Payout Tube and Plastic Payout Tubes", now U.S. Pat. No. 6,086,012. All of these patents are assigned to the same assignee as the present invention and the subject matter of these patents are incorporated in the specification of the subject application by reference.

BACKGROUND OF THE INVENTION

1. Field of the Invention

This invention relates to payout tubes for guiding filamentary material through a payout hole extending from the outer wind to the inner wind of a coil of filamentary material wound in a FIG. 8 wind, and in particular to such payout tubes made from corrugated fiber or plastic material and which have an oval, diamond, elliptical or round shape with an oversized opening to accommodate CAT 5, CAT 6 and CAT 7 cables for kinkless unwinding from the inner coil to the outer coil of the wound material. The invention is also useful in improving the payout of filamentary material other than CAT 5, CAT 6 and CAT 7. i.e. all filamentary material.

According to the invention, the payout tubes are made of molded plastic, molded paper pulp or made of corrugated fiberboard.

2. Related Art

Payout tubes for performing the function of guiding filamentary material through payout holes in wound coils are known to the art. The structure of such payout tubes is represented by the following patents all of which are assigned to the same assignee as the present application, and wherein:

(1) U.S. Pat. No. 4,274,607 entitled "Guide Device for Use in Elongate Filament Dispensing Package and the Like" discloses a tubular guide device inserted radially into a payout hole in a wound coil and through a hole in a carton containing the wound coil and includes means for securing the guide device to the carton.

(2) U.S. Pat. No. 4,367,853 and entitled "Guide and Support Members for Unwinding Flexible Material from a Wound Package" discloses specially shaped cones adapted to extend into the inner opening of the payout tube to prevent tangles and birdnesting as the filamentary material is unwound from the coil.

(3) U.S. Pat. No. 4,057,203 entitled "Package of Flexible Material with Oval Payout Tube" discloses an oval shaped payout tube that is inserted in the normal diamond-shaped payout hole of the wound coil.

(4) U.S. Pat. No. 4,022,399 entitled "Screw-in Tube with Breakable Tabs for Coil of Flexible Material with Inner End Payout" discloses a payout tube with spaced flanges for engaging the wall of the container retaining the wound coil and with the opposite end of the payout tube from the flanges being inserted into the radial payout hole of the wound coil.

(5) U.S. Pat. No. 3,985,315 entitled "Package of Flexible Material for Twistless Payout with Wide Funnel Guide" discloses the outer end of the payout tube shaped as a funnel.

SUMMARY OF THE INVENTION

Notwithstanding the aforementioned progess in the state of the art of payout tubes, the advances and development in wire cable has generated a need for new types of payout tubes to enable the proper twistless payout of wound wire cable from the inner wind to the outer wind and through a radial opening between the inner and outer windings (known in the trade as the REELEX system). In particular, the inherent residual twist characteristics of CAT 5, CAT 6 and CAT 7 cables require a much larger payout hole and payout tube to avoid kinking and interference with payout of the cable when wound in a figure 8 configuration and with a payout hole extending from the inner wind to the outer wind of the winding.

Furthermore, the present invention is related to U.S. Pat. No. 5,979,812 as noted above. The assignee has designated the new winding system as a REELEX II package and the payout tubes in accordance with the present invention form part of the new REELEX II package.

In accordance with the REELEX II package many new products may be used with the assignee's patented and licensed REELEX system. Products which had been considered too stiff, too flexible, too hard, too soft, too easily damaged, too prone to tangling, too large, or too small for REELEX packaging will work well in the REELEX II package. For example, single conductors, ultra-flexible cable and fiber optic cable are now all usable with REELEX II packaging. The new REELEX II package also significantly improves cold weather payout performance of many cable constructions.

With the use of corrugated paper board or paper pulp payout tubes in lieu of plastic payout tubes both the container and the payout tube are recyclable and thus the REELEX II corrugated paperboard cable package will satisfy the stringent waste reduction requirements of today's job sites and European "green" packaging regulations.

Alternatively, the plastic tubes of the present invention may be used in the REELEX II package where such use is desired, such as with stiff, robust wire cables that would tend to damage corrugated paper materials.

It is therefore a primary object of the present invention to provide in a package of wound filamentary material of the type specified herein, a payout tube that is made of corrugated paper product, paper pulp or plastic.

It is a primary feature of the present invention that the payout tube is formed of corrugated paper as is the carton containing the wound coil.

It is an advantage of the present invention that the corrugated paper tube and the corrugated paper carton are recyclable.

It is another object of the present invention to provide an enlarged payout tube that engages with an enlarged payout hole to provide payout of wound flexible material having unusually stiff, flexible, hard, soft, prone to tangling, large or small characteristics.

It is another feature of the payout tube of the present invention that an enlarged payout tube provides kinkless and tangle-free unwinding of filamentary material from a wound package.

It is a further advantage of the payout tube of the present invention that wound flexible material having unusually stiff, flexible, hard, soft, prone to tangling, large or small characteristics may be unwound without tangling or kinking.

BRIEF DESCRIPTION OF THE DRAWINGS

The above objects, features and advantages of the invention are readily apparent from the following description of preferred embodiments of the invention when taken in consideration of the following drawings, wherein:

FIG. 13A represents a coil with a 40 degree payout hole with a 1 inch OD payout tube; FIG. 13B represents a coil having a hole of 110 degrees using a round payout tube/guide of approximately 2.75 inches; FIG. 13C represents a coil that has a hole of 110 degrees and using a diamond-shaped payout guide; and FIG. 13D represents a coil having a hole of 110 degrees using a generally oval-shaped guide.

DETAILED DESCRIPTION

Figure 1:
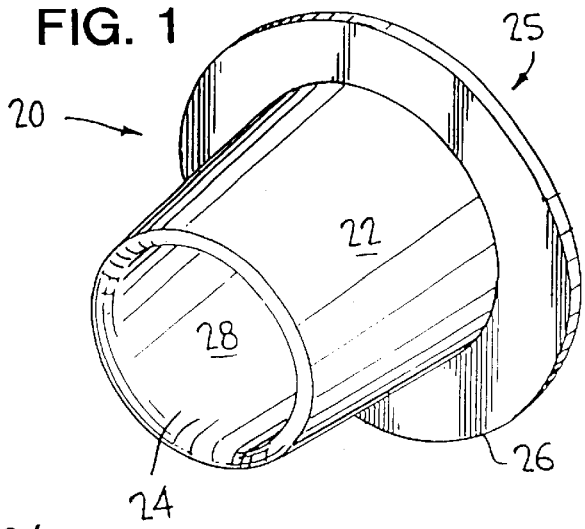
FIG. 1 is a perspective view of a payout tube in accordance with a first embodiment of the invention.

In the following description, a "nominal" size payout tube or payout hole refers to the size (diameter) of the payout hole or payout tube that is formed for filamentary material having little or no twist characteristics in accordance with the winding techniques disclosed in U.S. Pat. No. 5,678,778) High Speed, Dual Head, On-Line Winding Apparatus, U.S. Pat. No. 5,470,026, Uniform Width Payout Hole and U.S. Pat. No. 4,406,419, Method and Apparatus for Winding Flexible Material and all being assigned to Windings, Inc. the assignee of the present application. The respective disclosures of these patents are incorporated herein by reference. In accordance with the principles of the present invention, the payout hole is produced in the wound coil by producing a payout hole of ninety degrees (90) or larger. In present day state of the art REELEX winding machines that have digital input controls, the size of the hole (in degrees) may simply be dialed as an input to the winding machine control and the winding process will produce a payout hole having the dialed-in diameter.

Cylindrical-shaped Payout Holes/Tubes

Unless corrections are made during the normal REELEX winding proces such as set forth in Windings' U.S. Pat. Nos. 4,406,419 and 5,678,778, for example, a payout hole having a diamond shape rather than a circular shape will be produced. However, as disclosed in Windings' U.S. Pat. No. 5,470,026, a payout hole having a substantially constant diameter may be produced. As set forth in the description of this patent, a constant diameter coil results in eliminating or reducing "valleys" and lumpiness of wound coils. Commensurate with the decrease in the lumpiness of the wound coil is a reduction in the overall diameter of the wound coil (for a given wind), thereby resulting in a decreased overall diameter coil that can be packaged in a smaller container. Finally, maintaining the desired diameter payout hole results in a smaller circumference wind, thereby also attributing to a smaller diameter coil because increasing the size of the payout hole diameter as the coil is wound causes increasing circumference of the wind.

The REELEX winding process normally does not produce twist in the wound coil; however, such a winding process does not eliminate or reduce the inherent twist in certain filamentary materials such as CAT-type cables, for example. Thus, it is necessary to account for the twist in wound coils with such twist-inherent filamentary materials when a wound coil of such filamentary material is being unwound through the payout hole and payout tube.

The large diameter payout tube and payout hole according to the invention serves several functions.

1) It keeps the crossovers further away from the exit hole in the wound coil or cable, thereby limiting the radius of the loops that develop near the payout hole.

2) It allows any "backed-up" twist that develops a way to exit the package.

3) It allows the payout exit point the freedom to move away from the crossover or a developing loop. With a smaller diameter payout tube the exit point is essentially fixed so the crossover must move. If the crossover does not move, the figure 8 loop can become quite small.

4) Because the payout smoothness is so greatly enhanced there is little force on the payout tube during payout. This increases the options available for the material that can be used for producing the payout tubes. Tubes made from molded paper pulp and die cut cardboard or corrugated paper board have all been used with success.

Payout Hole/Tube Shapes Other than Cylindrical

The payout hole produced by the REELEX method of winding, as exemplified by the aforementioned U.S. patents, is already diamond-shaped and nothing special needs to be done to produce such a shape. Until recently the payout tubes have all had a round cross-section. As described above, by making the payout hole larger than nominal and using a large diameter (round) payout tube, the distance, in degrees, between the exit point and where the cross-over nearest the hole is greatly increased. Using an oval shape can increase this distance even more. The diamond and oval-shaped tube guides are similar to each other except that the corners are rounded in the case of oval-shaped guides/tubes.

What makes the diamond-shaped guide/tube interesting is that it can be made without expensive molding equipment and can be made from the waste portions of the corrugated material that is used to make the box for the coil.

All of the molded payout tubes have a generous radius at the "mouth" that helps smooth out the payout even further.

In fact all of the large payout tubes (guides) are tapered for improved payout characteristics, and because this allows them to be stacked inside one another, they will take up less room during shipment.

The wound coils or cable are produced with payout holes of in excess of 90 degrees of circumference. This is easily accomplished using any one of Windings, Inc.'s winding machines in existence (for example, see Windings, Inc.'s U.S. Pat. No. 4,406,419 and/or U.S. Pat. No. 5,678,778).

The hole slant is corrected for, and the constant hole size is adjusted for, using the methods described in the Windings, Inc.'s U.S. Pat. No. 5,470,026 for generating a uniform width payout hole.

The payout tube 20 of FIG. 1 is preferably made of injection molded plastic or pulp paper and includes body 22, coaxial entrance opening 24 and exit opening 25. As illustrated in FIG. 1, entrance opening 24 and exit opening 25 are circular (see FIG. 3) as will be explained more fully hereinafter. The distance between entrance 24 and exit 25 openings may be varied as desired to accommodate different sized diameter windings. Flange 26 extends around the circumference of exit opening 25 to engage the side panel of a container holding the wound coil as is well known to those skilled in the art of payout technology. Payout tube 20 is made of injection molded plastic in accordance with well-known plastic molding, pulp paper or corrugated paper techniques. The body 22 of payout tube 20 narrows from the diameter of exit opening 25 to the diameter of entrance opening 24 as illustrated in FIG. 1.

Figure 2:
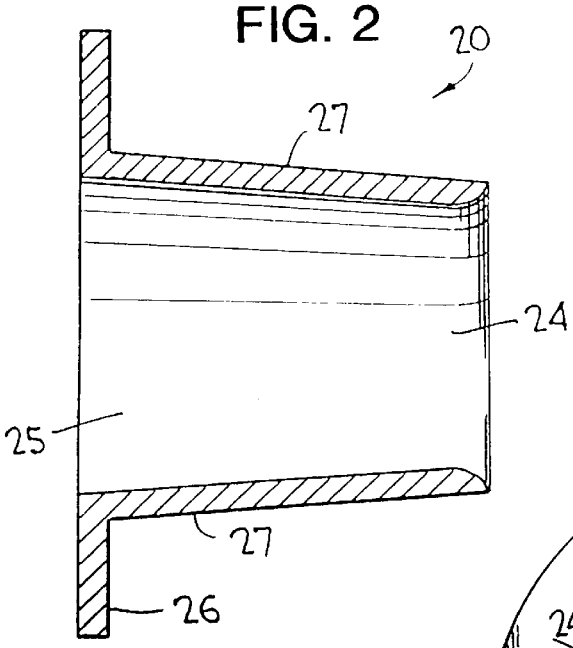
FIG. 2 is a side cross-sectional view of the payout tube of FIG. 1.

In the side view of the payout tube 20 shown in FIG. 2, the wall thickness of body 22 is approximately 0.04 inches for plastic tubes and ¼ inch for paper pulp tubes. The distance between the inside of entrance opening 24 and the outside of exit opening 25 is approximately 3.5 inches. The length of the payout tube 20 may be increased or decreased as necessary to accommodate the thickness of the wound coils with which the payout tube 20 is used. Flange 26 extends beyond the sides 27 of the payout tube 20 a sufficient amount to provide appropriate engagement of the flange with the side panel of the container (not shown).

Figure 3:
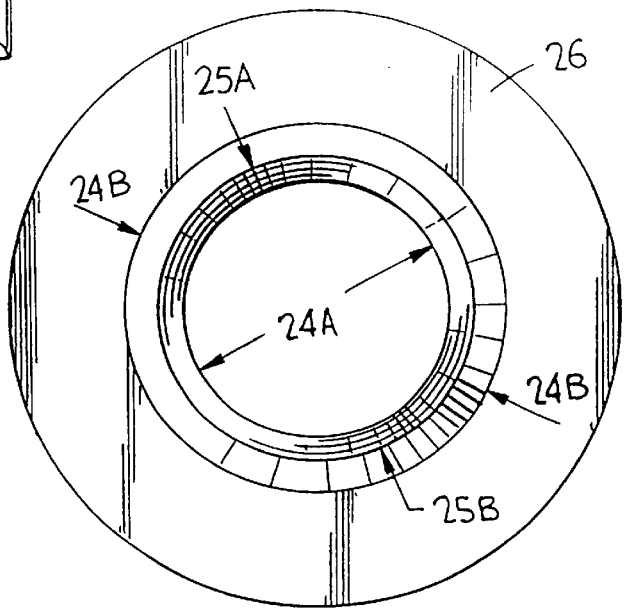
FIG. 3 is a view of the payout tube of FIG. 1 as seen from the exit opening side thereof.

FIG. 3 is a rear view of payout tube 20 (i.e. as viewed from the exit opening 24 end of payout tube 20) and shows the circular configuration of both the entrance 24 and exit 25 openings of the payout tube 20. The inner diameter 24A and outer diameter 24B of exit opening 24 differ by approximately 0.04 inches for plastic tubes and ¼ inch for paper pulp to provide suitable stiffness and ruggedness to accommodate stiff filamentary material. The inner diameter 25A and outer diameter 25B of exit opening 25 is also shown and preferably there is a difference of ½ inch in the respective diameters to provide a 0.04 inch for plastic tubes and ¼ inch thickness for pulp payout tubes of the body 22 of the payout tube 20. Exit opening 25 includes a flange portion 25B that rests against the outer surface of a container panel housing the wound coil (not shown) as is known to the art.

Entrance and exit openings 24 and 25 are sufficiently large to allow filamentary material wound in a configuration with a radial opening from the outer to the inner winds to be withdrawn from the inside of the coil and through the payout tube 20 without birdnesting or kinking. The configuration of the payout tube 20 in accordance with the invention essentially eliminates kinking and birdnesting of CAT 5, CAT 6 and CAT 7 cables and also improves the winding payout of all other filamentary material wound in accordance with the REELEX I and REELEX II techniques, for example as described in U.S. Pat. No. 4,406,419 for REELEX I and this application as well as application Ser. No. 09/063,278 for REELEX II techniques. For further explanation of the size of the openings to allow for kinkless payout, (see the explanation below as taken from U.S. Pat. No. 5,979,812).

Figure 5:
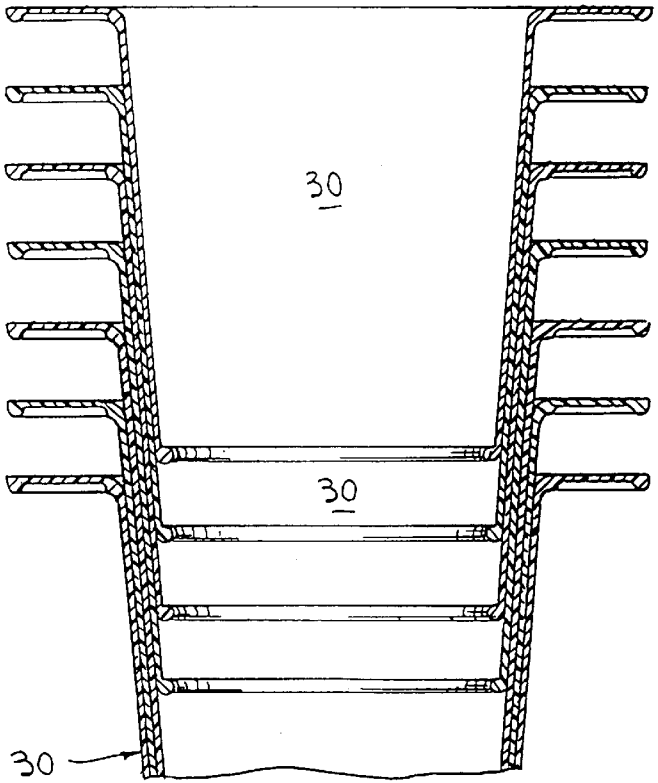
FIG. 5 is a cross-sectional view of a plurality of payout tubes of FIG. 4 shown in nested relationship.
Figure 4:
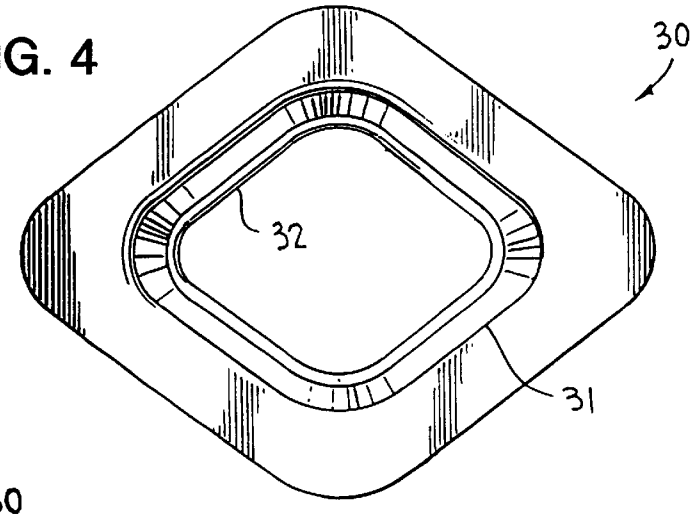
FIG. 4 is a front view of a second embodiment of a payout tube in accordance with the invention and made of plastic.
Figure 6:
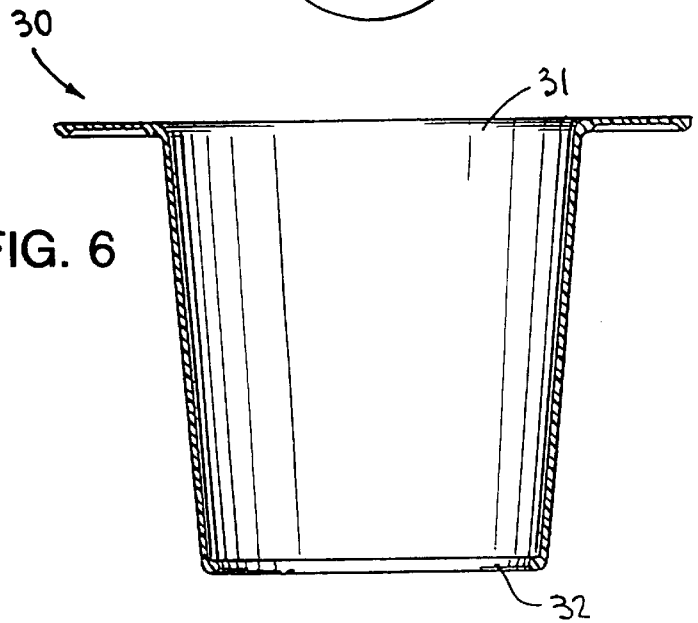
FIG. 6 is a cross-sectional view of the payout tube of FIG. 4.

FIGS. 4–6 illustrate another embodiment of the invention wherein the entrance and exit openings are oval in shape. In the top view of payout tube 30 the tube includes exit opening 31 and entrance opening 32, both in the form of a diamond, and wherein the dimensions of the two openings are as follows:

Width and length of the entrance opening are 2.49 and 1.77 inches, respectively; width and length of the exit diamond shaped opening are 5.06 and 3.66, respectively. FIG. 5 illustrates the manner in which the payout tubes 30 may be nested.

Figure 7:
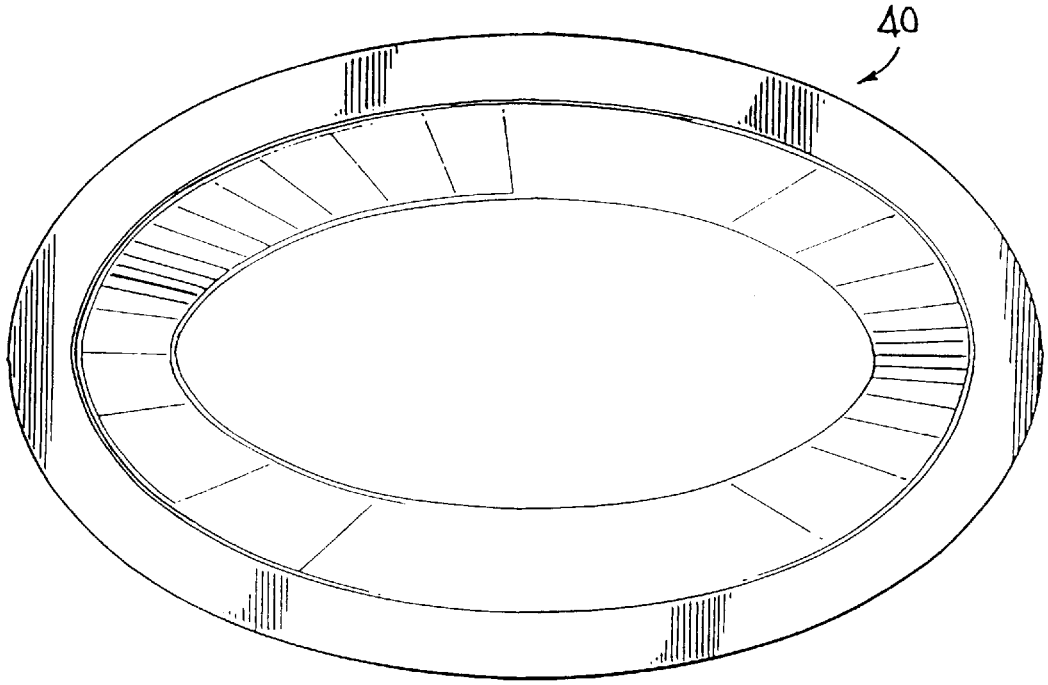
FIG. 7 is a front view of a third embodiment of the payout tube in accordance with the invention.
Figure 8:
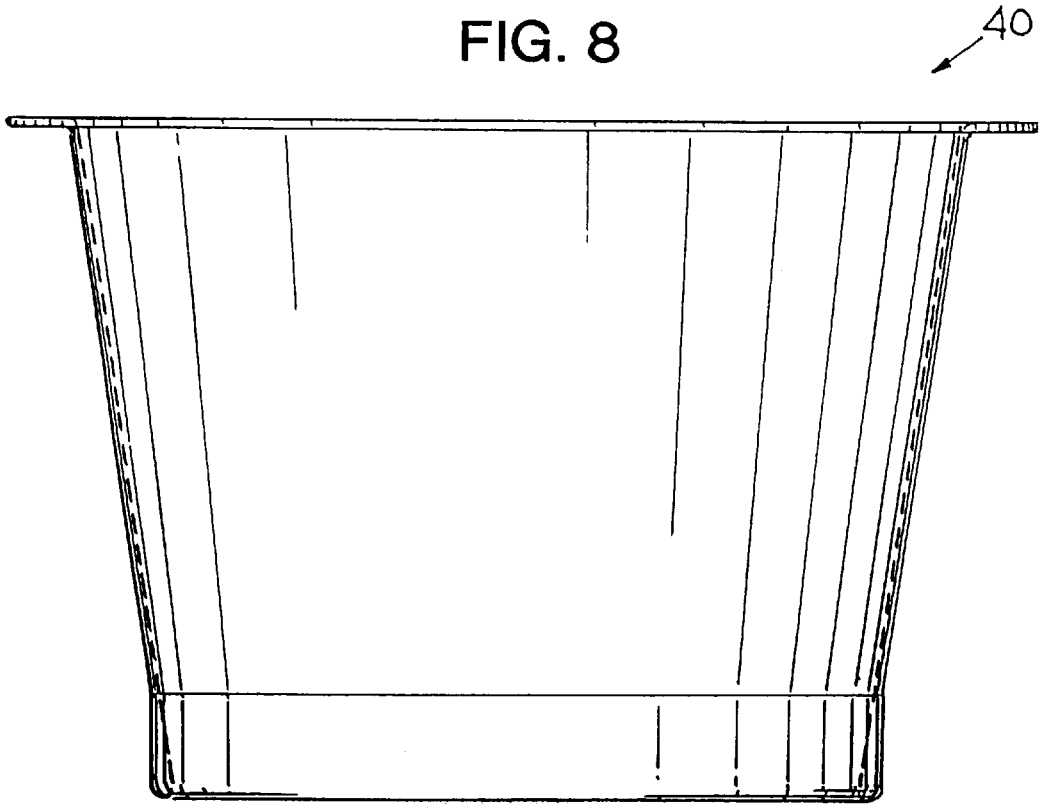
FIG. 8 is a side view of the third embodiment of the invention.

FIG. 7 simply illustrates an elliptical (football) shaped payout tube 40 and FIG. 8 shows a side view of the payout tube 40.

Figure 9B:
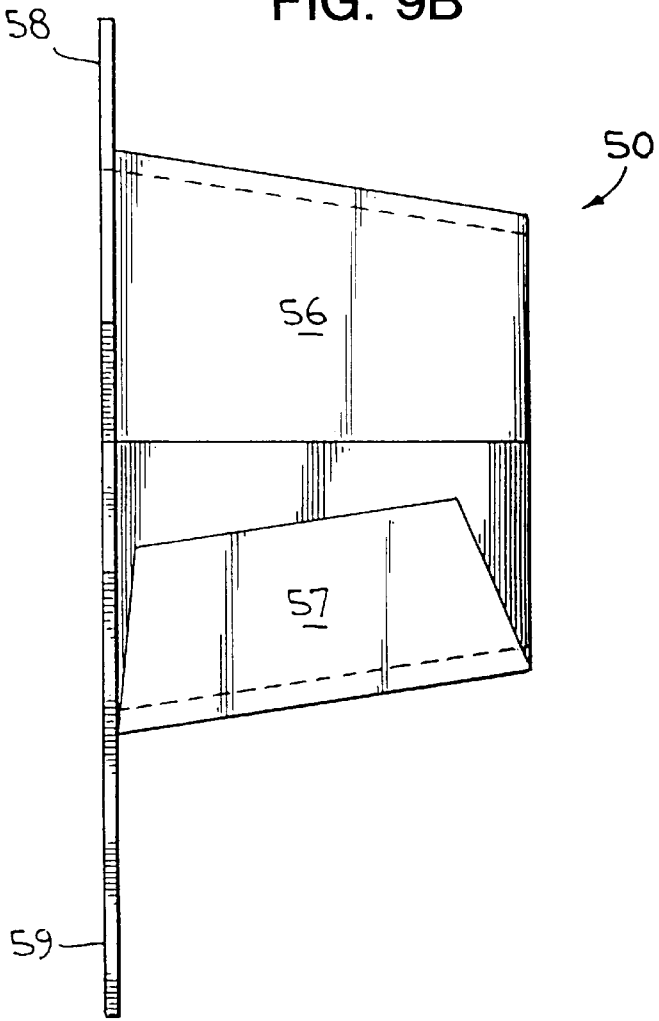
FIGS. 9A and 9B are respective front and side views of a fourth embodiment of the invention made from corrugated paper.
Figure 9A:
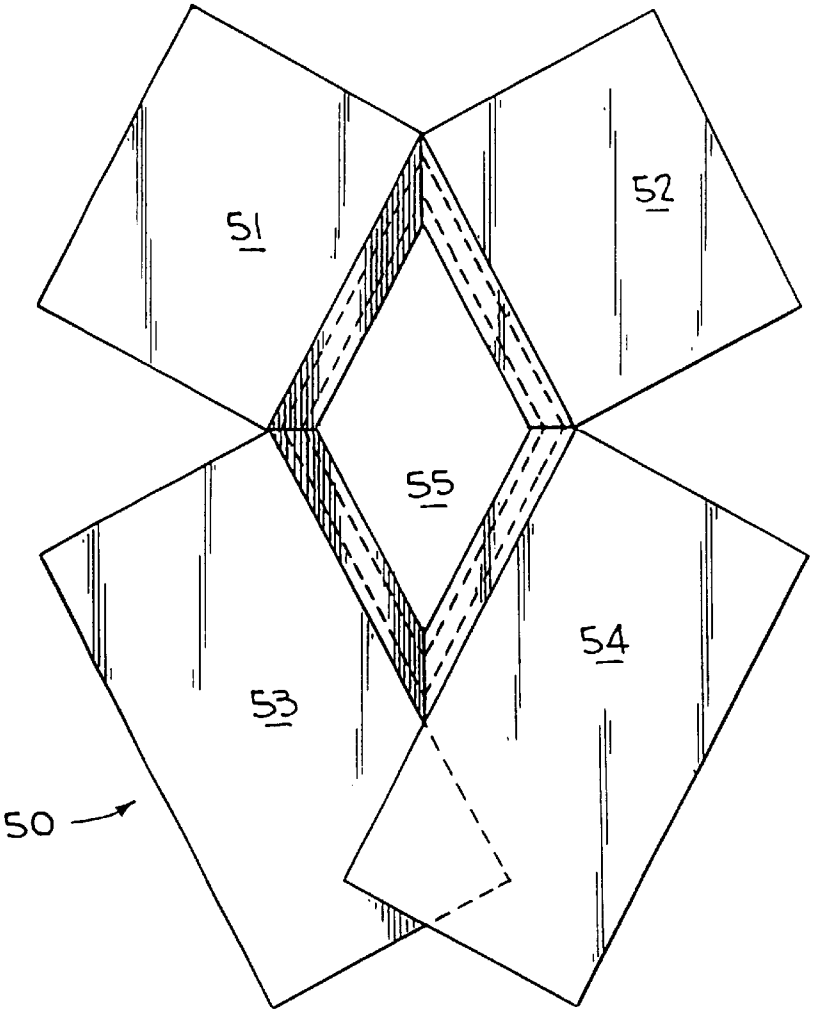

FIGS. 9A and 9B illustrates a payout tube 50 made of folded corrugated fiber and having a truncated shape as shown in FIG. 9B. Flaps 51, 52, 53 and 54 extending from the respective sides of the diamond-shaped exit opening 55 are folded to form the sides 56 and 57 of the payout tube 50. Flanges 58, 59 are formed by the folded flaps to engage the side panel of a container (not shown) to enable the payout tube 50 to remain in position with respect to the payout hole of the wound coil housed in the container.

The formation of the payout tube using corrugated fiber or other paper products provides a significant advantage with respect to the ecological disposal of the payout tube, for example as compared with a payout tube formed of plastic.

Figure 10A:
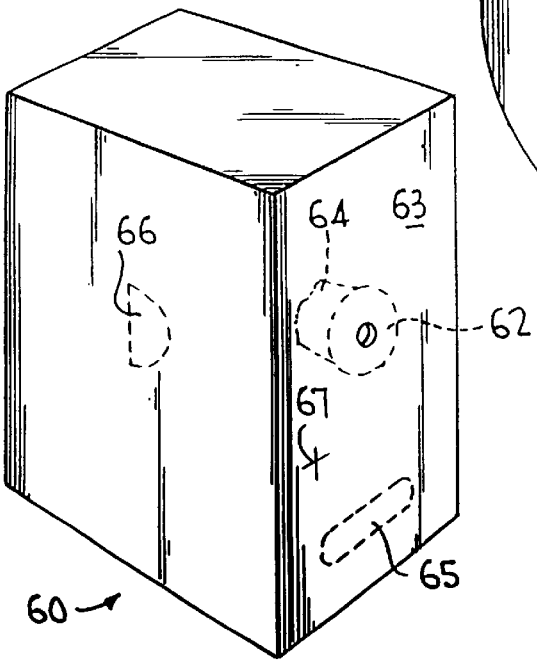
FIG. 10A is a cut-away perspective view of a fifth embodiment of the invention in which the payout tube and the container holding the wound coil are each made of corrugated paperboard.

A combined container and payout tube in accordance with a fourth embodiment of the invention is illustrated in FIG. 10A and shows container 60 for holding a wound coil of filamentary material (not shown) and including a payout hole extending from the inner coil to the outer coil and formed in accordance with the method disclosed in previously mentioned U.S. Pat. No. 5,979,812. A serrated opening 62 is provided in panel 63 and is opened to allow the wound filamentary to be removed from the container 60. The filamentary material (not shown) is threaded through a payout tube 64 shown in phantom lines and which is incorporated as part of the container 60 as will be more fully described hereinafter. Hand hold 65 enables container 60 to be carried from site to site. Semi-circularly-shaped cutout provides access to the interior of container 60 after it is assembled as is described more fully hereinafter with respect to FIG. 10B.

Container 60 is dimensioned in accordance with the diameter of the wound coil that is to be contained therein and may be manufactured in standard sizes to accommodate standard diameters of wound coils. For example, the container 60 shown in FIG. 10A may be 9.5 inches×13.5 inches to accommodate a 12 inch diameter wound coil. Opening 62 may be circular-shaped, diamond-shaped, or oval-shaped in conformance with the disclosure in application Ser. No. 09/063,278. Cross-shaped opening 67 enables the end of the filamentary material protruding from opening 62 to be inserted to prevent it from freely moving in a random manner and falling back into the container.

Figure 10B:
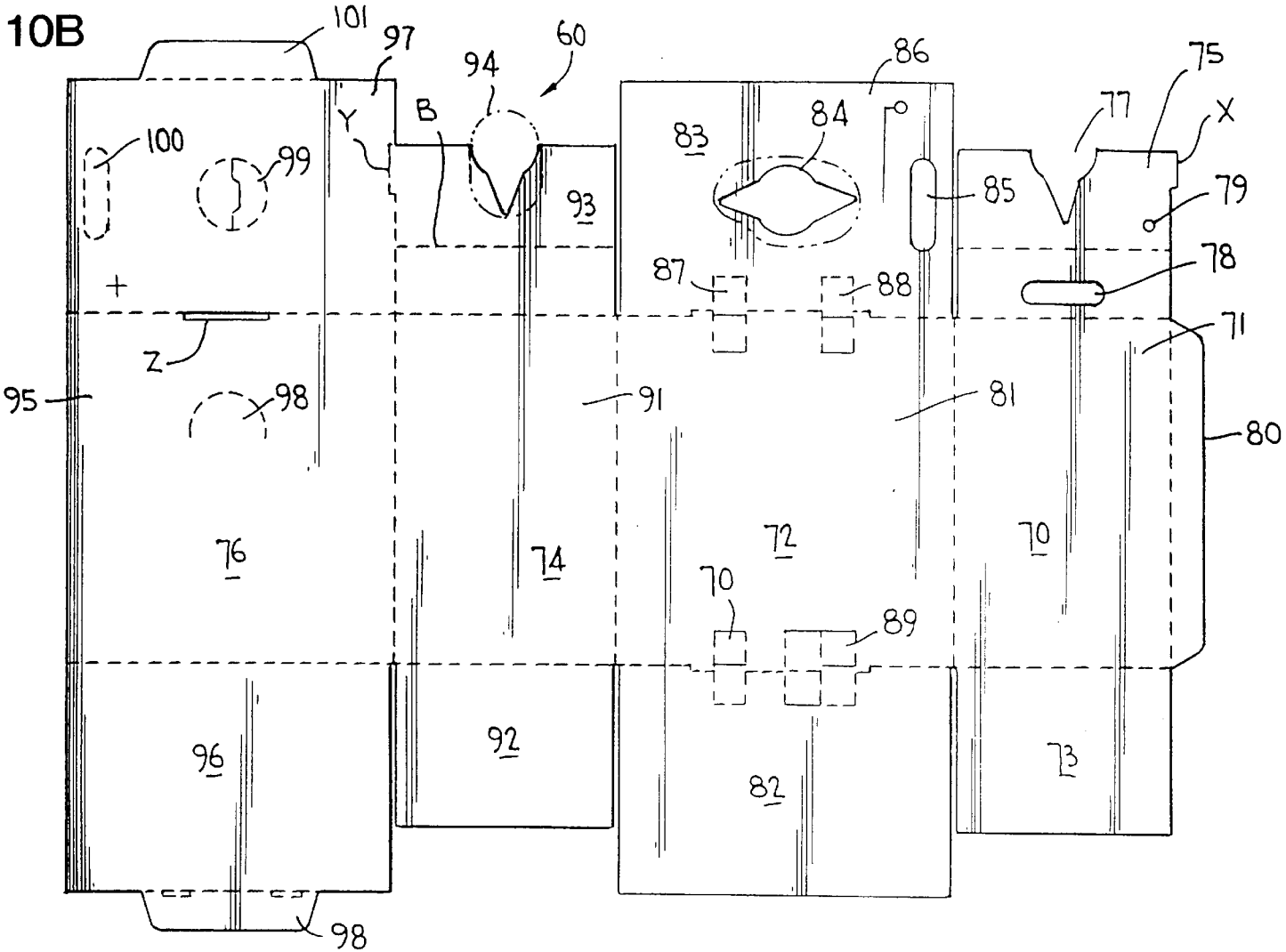
FIG. 10B illustrates a plan view of each of the respective sections of the corrugated paperboard forming the embodiment of FIG. 10A.

FIG. 10B shows a plan view of container 60 as it appears in unassembled form and consists of four sections, namely sections 70, 72, 74 and 76. First section 70 includes end panel 71, bottom panel 73 and top panel 75. Top panel 75 in turn includes V-shaped cutout 77 which forms part of a diamond-shaped payout tube to be more fully described hereinafter. Hand hold 78 enables the container 60 to be carried about as desired. Serrated hole 79 enables the end of the filamentary material of the wound coil to be inserted, thereby preventing it from moving freely. Flap 80 at the side of end panel 71 is a glue flap that connects panel sections 70 and 76 during the manual process that produces the box.

Second section 72 comprises side panel 81, bottom panel 82 and top panel 83. Top panel 82 includes a diamond-shaped payout tube opening 84, hand-hold 85, opening 86, which aligns with opening 79 in top panel 75. Flaps 87 and 88 in top panel 83 provide a means for securing top panel 83 with a counterpart top panel in fourth section 76 to be described more fully hereinafter. Flaps 89 and 90 in bottom panel 82 also aid in securing bottom panel 82 with a counterpart bottom panel in fourth section 76.

Third section 74 comprises an end panel 91, bottom panel 92 and top panel 93. Top panel 93 includes the other half of the diamond-shaped and round-shaped opening payout tube 94 formed along with V-shaped cutout 77 in top panel 75 when the various sections of the container are folded over during assembly.

Fourth section 76 includes side panel 95, bottom panel 96 and top panel 97. Side panel 95 includes port 98 which provides access to the wound coil when container 60 is assembled. Bottom panel 96 includes flap 98 for engaging a counterpart opening in the bottom panel 82. Top panel 97 includes serrated opening 99, which is aligned with payout tube opening 84 in top panel 83 when container 60 is assembled. Once the box is assembled serrated hand hold 100 aligns with hand-holds 78 and 85 providing three larger corrugated thicknesses and increased strength for carrying the container 60. Flap 101 engages a counterpart opening in top panel 83 when the container 60 is assembled by folding over the various sections described above.

The procedure for assembling the container 60 is as follows:

(1) The payout tube (round, diamond or oval-shaped) is inserted into the hole of the coil.

(2) The coil is then inserted into the box (after the bottom is made and the coil material is threaded through the guide tube).

(3) The flaps 75 and 93 are slid under the flange of the tube by bending the flaps at A and B. At this point a round tube will be held by the round portion of the cutout 77/94. A diamond will be held in place and in shape by the pointy area of the cutout 77/94. The side flaps 75 and 93 both have tabs (X & Y) that mate with slot Z. When these tabs are mated with the slot the two flaps prevent the tube from falling into the box when the coil is completely payed out.

(4) The flap 83 is folded over the tube, which helps hold the tube in place along with the top flap 97.

When the container 60 is assembled as shown in FIG. 10A, and as described above, with a wound coil of filamentary material enclosed therein, the end of the filamentary material (not shown) is unwound through the payout tube 71, 77, and 84 without kinking or birdnesting. The combined container and payout tube structure according to the invention provides a single structure for housing and paying out the wound filamentary material. The construction of the container 60 of corrugated paperboard makes the payout tube and the container recyclable.

In summary, the round paper pulp guide tube has a wall thickness of approximately ¼ inch and may be made in various lengths depending on the coil size with a 2½ inch entrance opening as illustrated in FIG. 1. The diamond-shaped (with round corners) paper pulp guide tube has a wall thickness of approximately ¼ inch and has the approximate dimensions as the diamond shape discussed in the above description. The paper pulp material has the distinct advantages of being biodegradable and recyclable. It is also the least expensive of the three materials disclosed herein and may be purchased close to any location where it is to be used, thereby significantly reducing transportation costs.

The round plastic guide tube has a wall thickness of approximately 0.04 inches, is biodegradable and has the advantage of stacking more efficiently than the pulp paper guides. This makes shipping costs lower, plus the other advantages mentioned in the above description. The advantage of the round tube over the diamond-shaped corrugated tube is that they tend to retain their shape once inserted into the payout hole. At most they may tend to become oval. However, the side flaps 75 and 93 (FIG. 10B) form a diamond shape opening once placed behind the flange of the guide tube and help to retain the diamond shape.

The above description serves only to describe exemplary embodiments of the best mode of making the combined fiber container and payout tubes and plastic payout tubes to demonstrate the features and advantages of its construction and operation. The invention is not intended to be limited thereby, as those skilled in the art to which the invention is directed will readily perceive modifications of the above-described embodiments. Thus the invention is intended to be limited only by the following claims and the equivalents to which the claimed components thereof are entitled.

Figure 11:
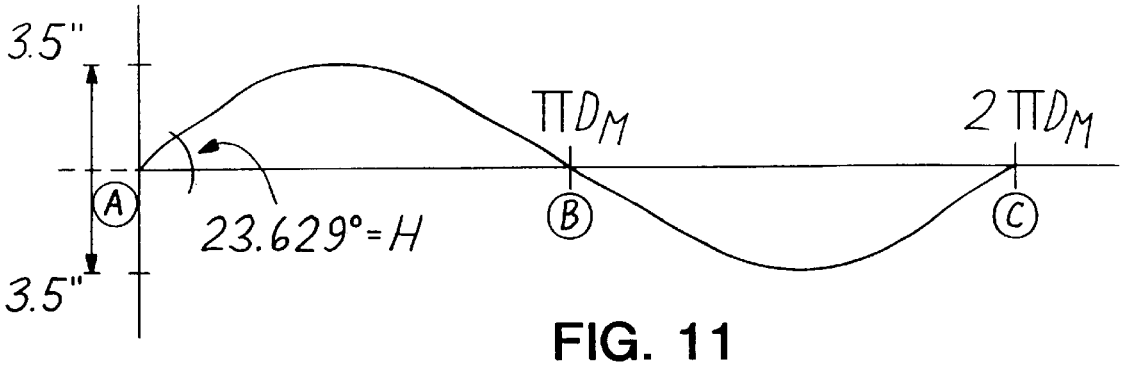
FIG. 11 is a general representation of one figure 8 of a REELEX coil laid out flat.

The general representation of one figure 8 of a REELEX coil laid out flat and shown in FIG. 11 represents two revolutions of the mandrel. If the coil in FIG. 11 were wrapped around a circle of proper diameter such that the points marked A and B were located at the same point would represent one revolution of the mandrel. If the representation were wrapped around the same circle twice, points A, B and C would be coincident and a complete FIG. 8 would be represented. In this example the figure 8 is wound on an 8" mandrel and the loops of the figure 8 extend 3.5" on either side from the center of the mandrel. The pattern is roughly a sinusoid represented by equation (1):

$$Yc=3.5 \sin x/Dm \tag{1}$$

where Dm is the diameter of the mandrel, X is the length along the circumference and Yc is the coil pattern.

Equation (2) is the first derivative of equation (1):

$$Yc'=3.5/Dm \operatorname{Cos} x/Dm \tag{2}$$

at $$x=0;\ Yc'=3.5/Dm$$

and the slope $H=\mathrm{Tan}^{-1}[3.5/\mathrm{Dm}]=23.629$ degrees

Figure 12:
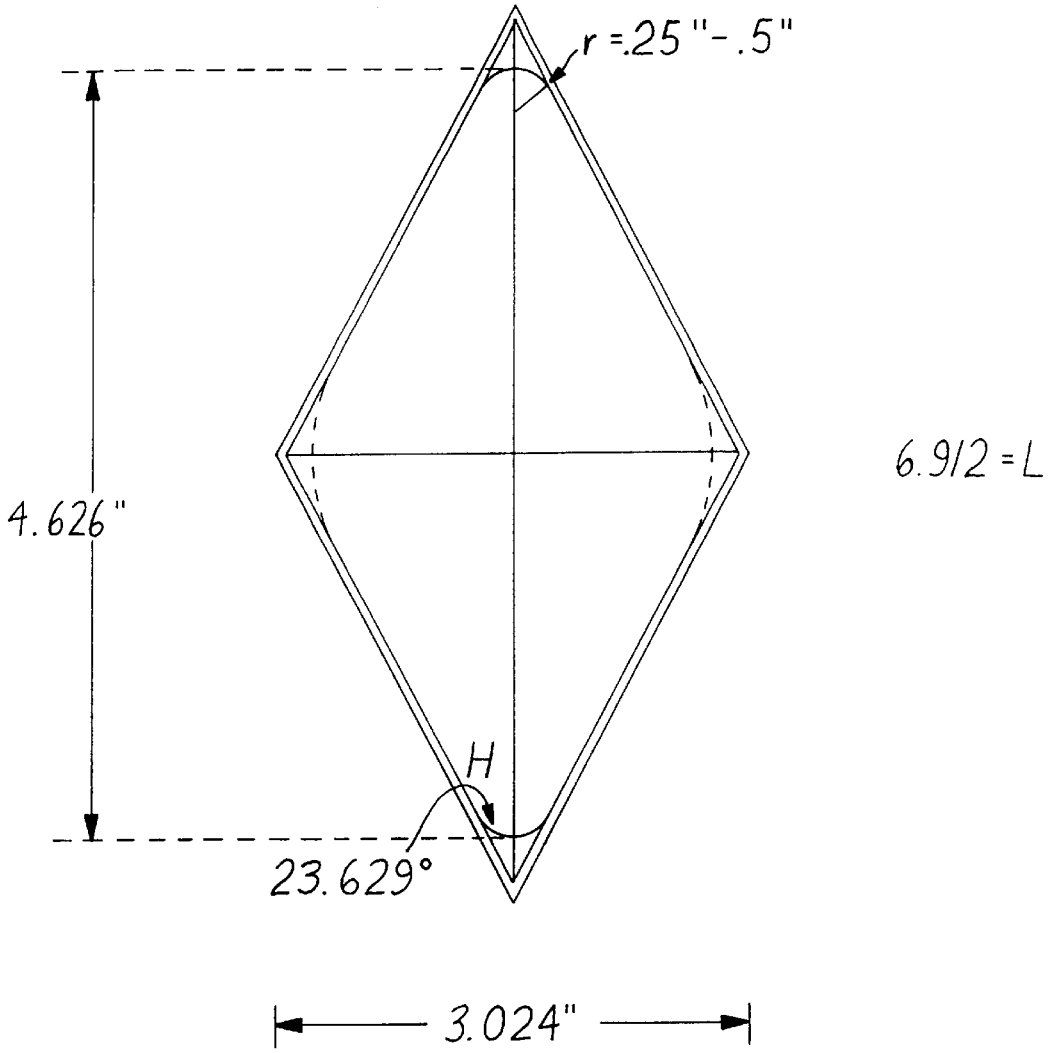
FIG. 12 illustrates a payout hole in accordance with one aspect of the invention.

FIG. 12 illustrates the commensurate payout hole. If the hole is created to be 99 degrees then it exists for 99/360 of the circumference, which for an 8" mandrel is L=99×8×Pi/360=6.912". With this data and the angle (H), the width of the payout hole is found to be 3.024". Therefore, the opening of the tube is a diamond that is 6.912" long and 3.024" wide. However, it has been found that the wire gets caught in the narrow V's at the ends of the long dimension. Also a payout tube created in this way is weak and subject to cracking (especially for plastic). A radius of ¼" to ½" is created as shown. The new length is 4.626". The minor dimension of the guide tube is simply rounded as shown in FIG. 12, thereby reducing the width but not less than 2½". The current tube is about 2¾".

If the payout hole were produced with a constant angle the size of the hole would be 13.824" by 4.32" at the end of a 16" diameter coil. However, the payout holes are not produced with a constant angle, but they are larger. The shape of the payout tube, its taper in this case, is more a function of molding and stacking stability. Thus, for example, a ¾" taper from the entrance of the payout tube to the exit thereof may be approximately ¾" to enable the payout tubes to be stacked, thereby enhancing their transportability.

Figure 13B:
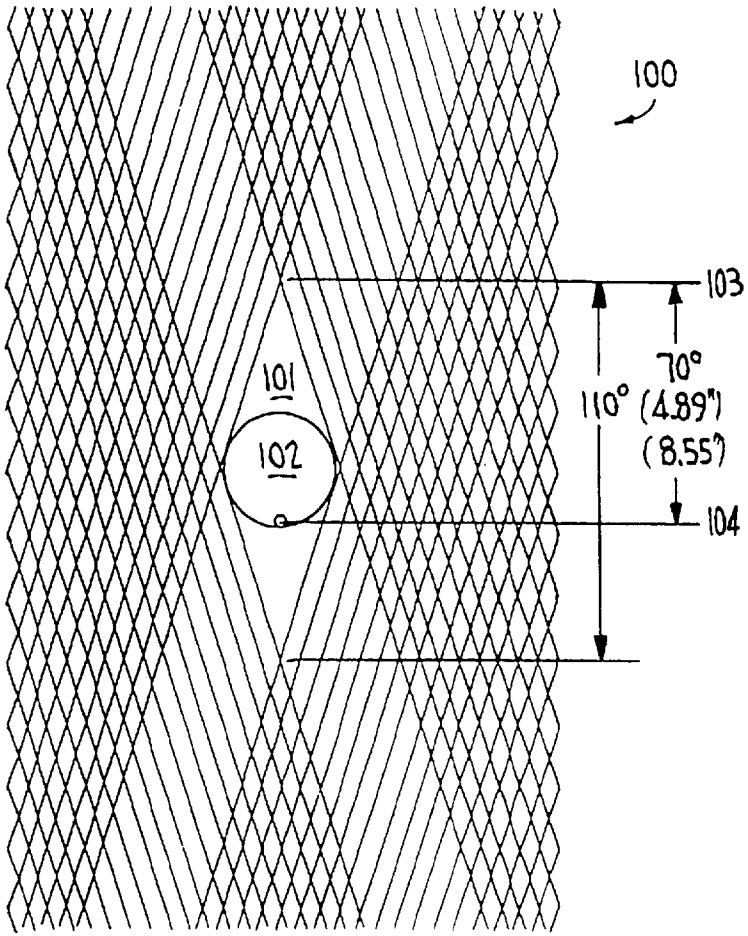
FIGS. 13A–13D illustrate different coils with various shaped guides/tubes in accordance with the invention and wherein a center portion of the coil is shown laid out flat.
Figure 13A:
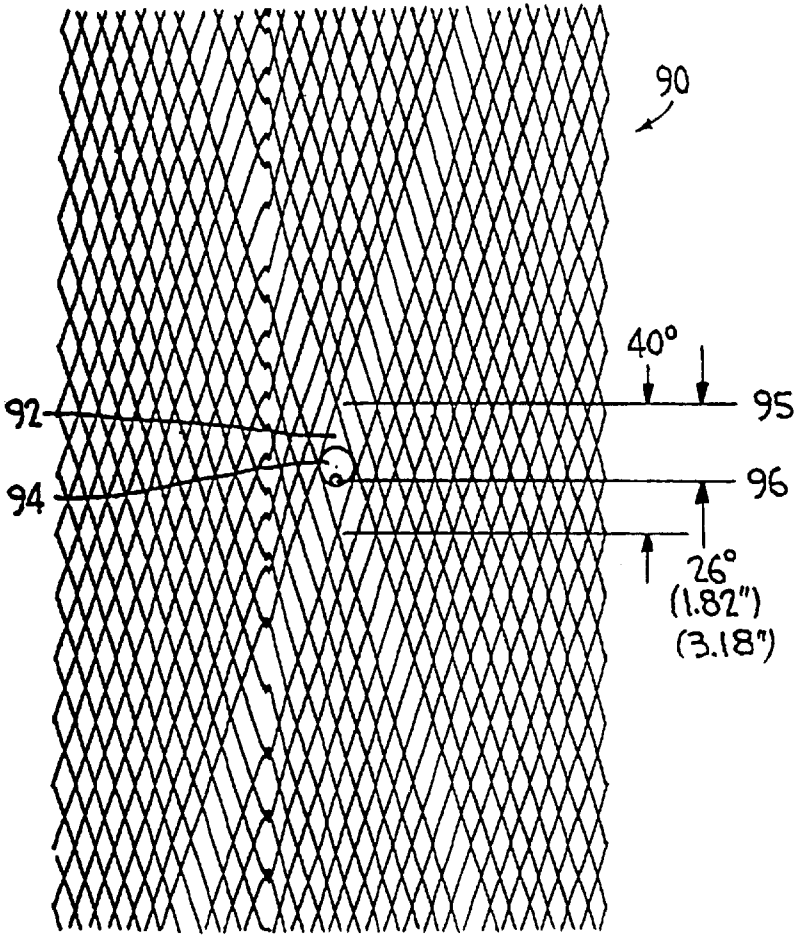

The wound coil 90 shown in FIG. 13A has a 40 degree payout hole 92 with a 1 inch OD payout tube 94. The distance between the top cross-over 95 and the exit point 96 is approximately 26 degrees as illustrated in the Fig. This subtends a coil arc of 1.82 inches on an 8 inch mandrel and a 3.18 inch coil arc at 14 inches (14 inches is chosen because this is the nominal size for CAT5-CAT7 unshielded cables).

The wound coil 100 shown in FIG. 13B has a payout hole 102 of 110 degrees using a round payout tube/guide 102 of approximately 2.75 inches. The crossover 103 and exit point 104 distance is 70 degrees which corresponds to coil arcs of 4.89 inches and 8.55 inches for an 8 inch mandrel and a 14 inch coil, respectively.

Figure 13D:
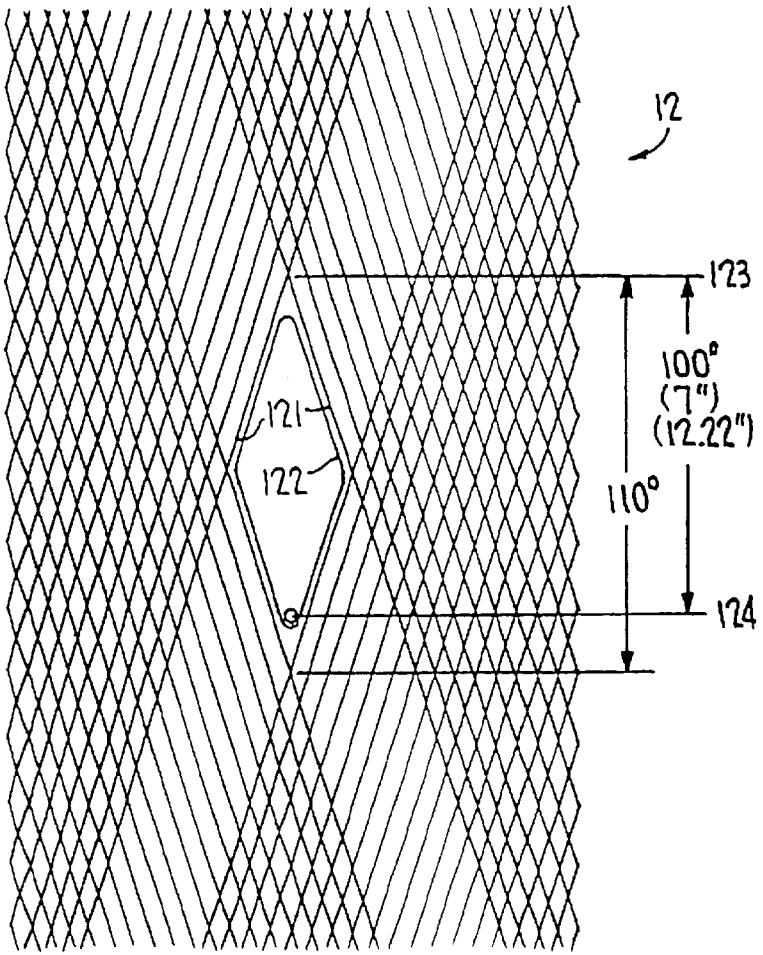
Figure 13C:
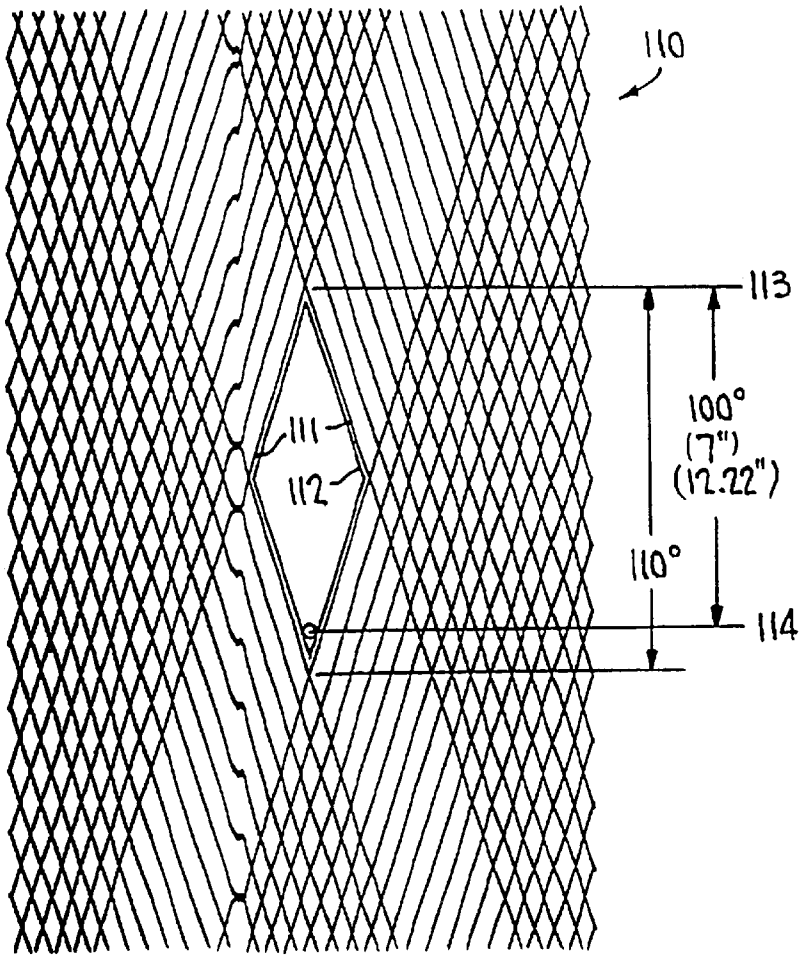

The wound coil 110 shown in FIG. 13C has a diamond-shaped hole 111 of 110 degrees and includes a diamond-shaped payout guide 112. The crossover 113 and exit point 114 distance is 100 degrees which corresponds to coil arcs of 7 inches and 12.22 inches for an 8 inch mandrel and a 14 inch coil, respectively.

The wound coil 120 shown in FIG. 13D has a payout hole 121 of 110 degrees and uses a generally oval-shaped guide 122. The crossover 123 and exit point 124 distance is 100 degrees which corresponds to coil arcs of 7 inches and 12.22 inches for an 8 inch mandrel and 14 inch coil, respectively.

It is apparent that, since the distance from the exit point and the crossovers nearest the payout hole are greatly increased, the filamentary material (cable or wire) does not have to experience anywhere as much bending stress with a larger than nominal hole and guide in accordance with the method of the invention. Moreover, the larger than nominal payout hole/tube of the invention is better than the nominal prior art-sized payout holes/tubes for many electronic and fiber optic cables as the bending radius of the coil is increased over that afforded by prior art winding techniques. Furthermore, the payout is also much smoother because the bending forces are much lower. With the smaller payout hole and tube, as the bending radius decreases, and the forces increase, the cable tends to spring free from the coil wall, placing many loops in the path of the exiting cable. This is reduced (or even eliminated) with the large hole. This is all in addition to the twist that is allowed to exit the package.

Therefore, it is desired that the present invention not be limited to the embodiments specifically described, but that it include any and all such modifications and variations that would be obvious to those skilled in this art. It is our intention that the scope of the present invention should be determined by any and all such equivalents of the various terms and structure as recited in the following annexed claims.

What is claimed is:

1. A payout tube for insertion in a radial hole of a wound coil of filamentary material and said radial hole extending from the inner to the outer wind of said wound coil, said payout tube comprising:

an entrance and an exit opening in coaxial and spaced relationship with one another:

the size of said entrance opening is determined by the following:

$$Yc=3.5 \sin x/Dm$$

where Dm is a diameter of the mandrel on which the coil of filamentary material is wound, x is the length along the circumference of the wind and Yc is the substantially sinusoidal FIG. 8 coil pattern;

$$Yc'=3.5 \text{ Dm Cos } x/\text{Dm}$$

$$\text{At } x=0;\ Yc'=3.5/\text{Dm};$$

and the slope H of the coil pattern $=\text{Tan}^{-1}[3.5/\text{Dm}]=23.629$ degrees;

the length L of the opening is determined as:

$$L=PTO \times Dm \times pi/360 \text{ degrees};$$

where PTO is the size of the entrance opening in degrees;

the width of the payout tube is W=L Cos (H);

the size of the exit opening is determined as being a fixed amount of degrees less than the entrance opening; and a flange member surrounding the exit opening for engaging a panel of a container retaining the wound coil.

2. The payout tube of claim 1, wherein the payout tube is made of pulp paper material.

3. The payout tube of claim 2 wherein both said entrance and exit openings are circular shaped.

4. The payout tube of claim 3, wherein the inner diameter of said entrance opening is 2.5 inches, the inner diameter of said exit opening is 3.0 inches, the thickness of said payout tube is 0.25 inches and the width of said flange is 5.75 inches.

5. The payout tube of claim 3, wherein the inner diameter of said entrance opening is 2.5 inches, the inner diameter of said exit opening is 2.60 inches, the thickness of said payout tube is 0.04 inches and the width of said flange is 5.75 inches.

6. The payout tube of claim 2, wherein both said entrance and exit openings are substantially oval shaped.

7. The payout tube of claim 2, wherein both said entrance and exit openings are substantially diamond shaped.

8. The payout tube of claim 7, wherein the length of said entrance diamond opening is 2.49 inches, the length of said exit diamond opening is 5.06 inches, the width of said entrance diamond opening is 1.77 inches, and the width of said exit diamond opening is 3.66 inches.

9. The payout tube of claim 2, wherein both said entrance and exit openings are substantially elliptically shaped.

10. The payout tube of claim 1, wherein the payout tube is made of plastic.

11. The payout tube of claim 10, wherein both said entrance and exit openings are circular shaped.

12. The payout tube of claim 10, wherein the inner diameter of said entrance opening is substantially 2.5 inches, the inner diameter of said exit opening is substantially 3.0 inches, the thickness of said payout tube is substantially 0.25 inches and the width of said flange is substantially 5.75 inches.

13. The payout tube of claim 10, wherein the inner diameter of said entrance opening is substantially 2.60 inches, the thickness of said payout tube is substantially 0.04 inches and the width of said flange is substantially 5.75 inches.

14. The payout tube of claim 10, wherein both said entrance and exit openings are substantially oval shaped.

15. The payout tube of claim 10, wherein both said entrance and exit openings are substantially diamond shaped.

16. The payout tube of claim 15, wherein the length of said entrance diamond opening is substantially 2.49 inches, the length of said exit diamond opening is substantially 5.06 inches, the width of said entrance diamond opening is substantially 1.77 inches, and the width of said exit diamond opening is substantially 3.66 inches.

17. The payout tube of claim 10, wherein both said entrance and exit openings are substantially elliptically shaped.

* * * * *